US005646615A

United States Patent [19]

Moore

[11] Patent Number: 5,646,615

[45] Date of Patent: Jul. 8, 1997

[54] TREADLE AND ROADWAY TREADLE ASSEMBLY

[76] Inventor: Curtis W. Moore, 976 Plouvier Rd., Hodgenville, Ky. 42748

[21] Appl. No.: 329,437

[22] Filed: Oct. 26, 1994

[51] Int. Cl.[6] ..... G08G 1/02

[52] U.S. Cl. ..... 340/940; 340/664; 340/665; 340/666; 200/86 R

[58] Field of Search ..... 340/940, 664, 340/555, 556, 665, 666; 200/85 R, 86 A, 86 R; 250/227

[56] References Cited

U.S. PATENT DOCUMENTS

| | | | |
|---|---|---|---|
| 2,761,928 | 10/1956 | Bicooper et al. | 200/86 R |
| 2,885,508 | 5/1959 | Wilcox | 200/86 R |
| 4,245,219 | 1/1981 | Dempsey et al. | 340/666 |
| 4,443,700 | 4/1984 | Macedo et al. | 250/227.16 |
| 4,455,465 | 6/1984 | Habeger | 200/86 R |
| 4,830,461 | 5/1989 | Ishiharada et al. | 385/13 |
| 4,839,480 | 6/1989 | Bickley | 200/86 A |
| 4,963,705 | 10/1990 | Broderick et al. | 200/86 R |
| 5,250,769 | 10/1993 | Moore | 200/86 R |

*Primary Examiner*—Jeffery Hofsass
*Assistant Examiner*—Davetta Woods
*Attorney, Agent, or Firm*—Jones & Askew, LLP

[57] ABSTRACT

An optical treadle of extended longevity is disclosed. The treadle is of unitary construction with an improved cross-sectional passageway shape that more effectively interrupts light when a vehicle tire passes thereover. A treadle assembly with permanently affixed light transmitting and light receiving means is also provided such that a failed assembly can be quickly replaced as a unit. Further, a roadway treadle assembly comprising a frame for installation in a roadway and an adapter plate for adapting a preexisting treadle frame are provided for mounting the treadle assembly across a surface portion of a roadway.

29 Claims, 5 Drawing Sheets

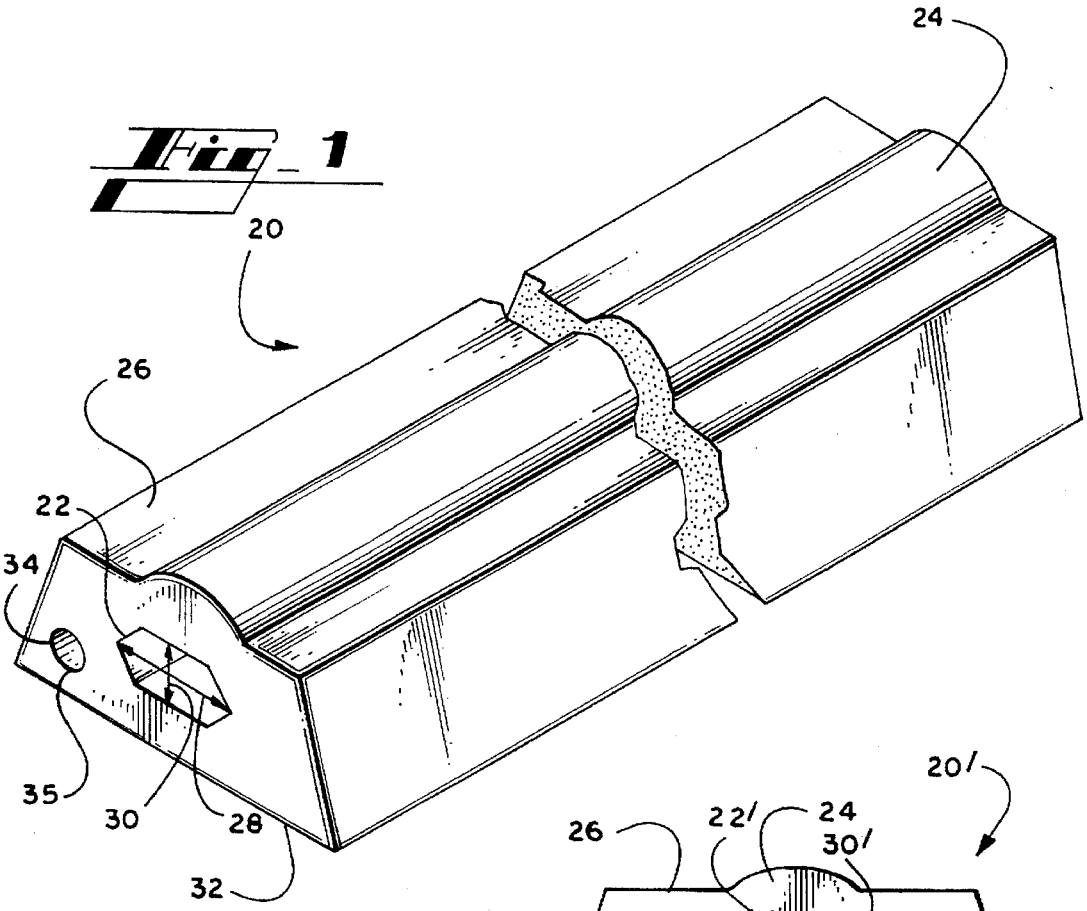
Fig_1
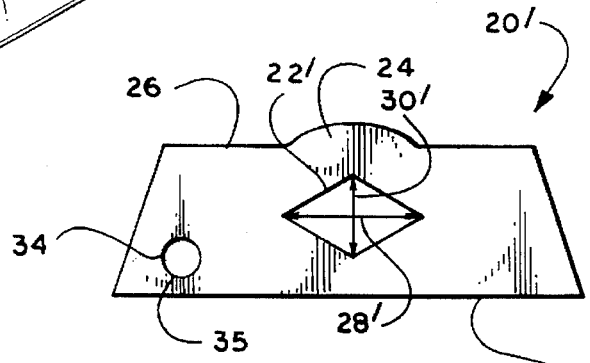
Fig_2
Fig_3
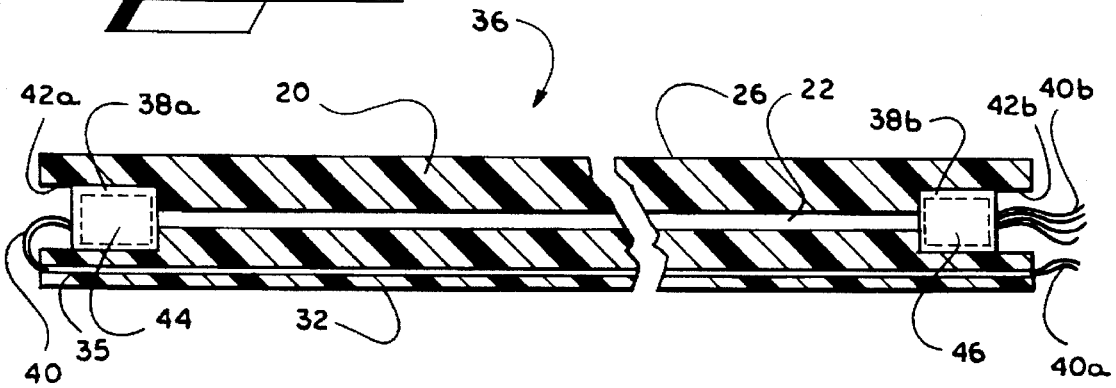

Fig. 4A
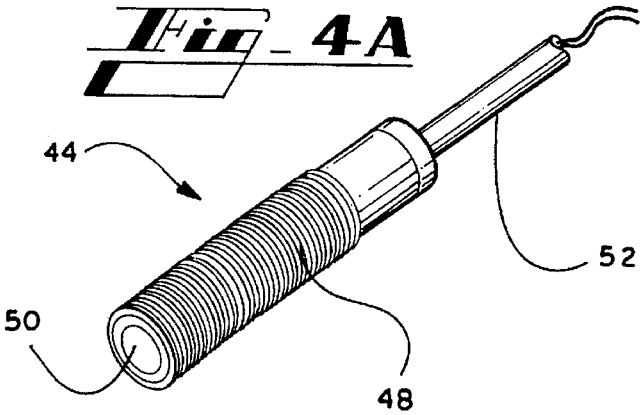
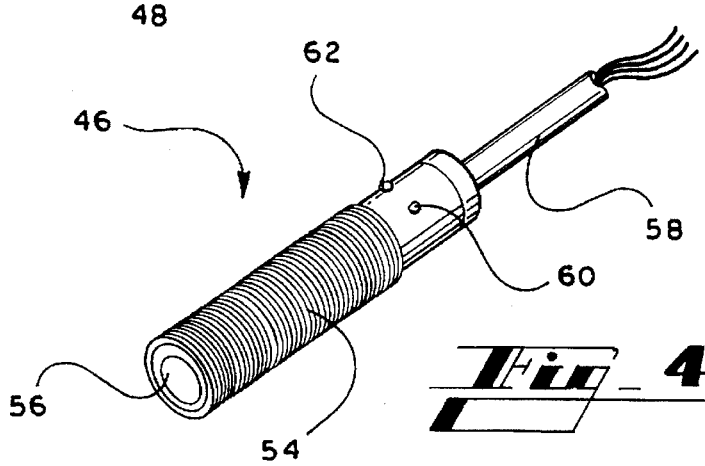
Fig. 4B
Fig. 5
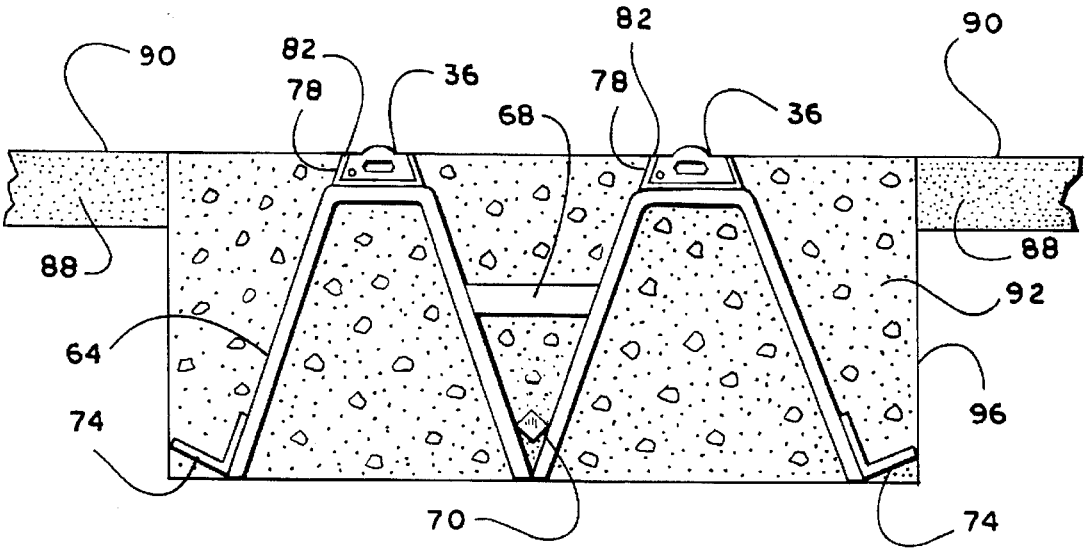

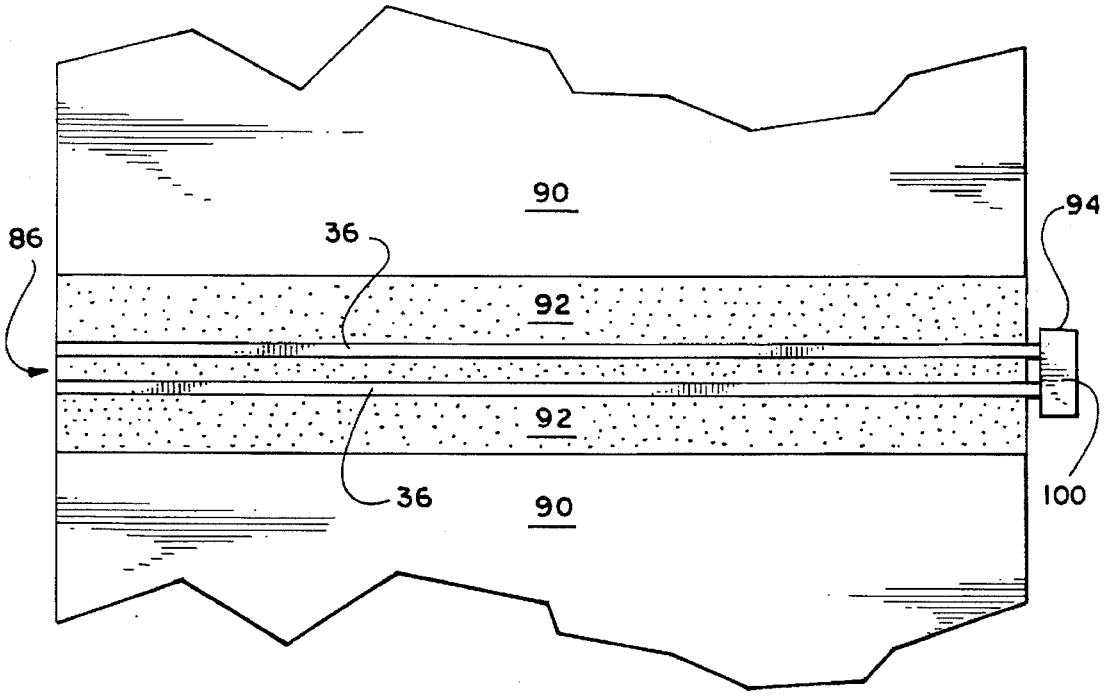
Fig_6
Fig_7
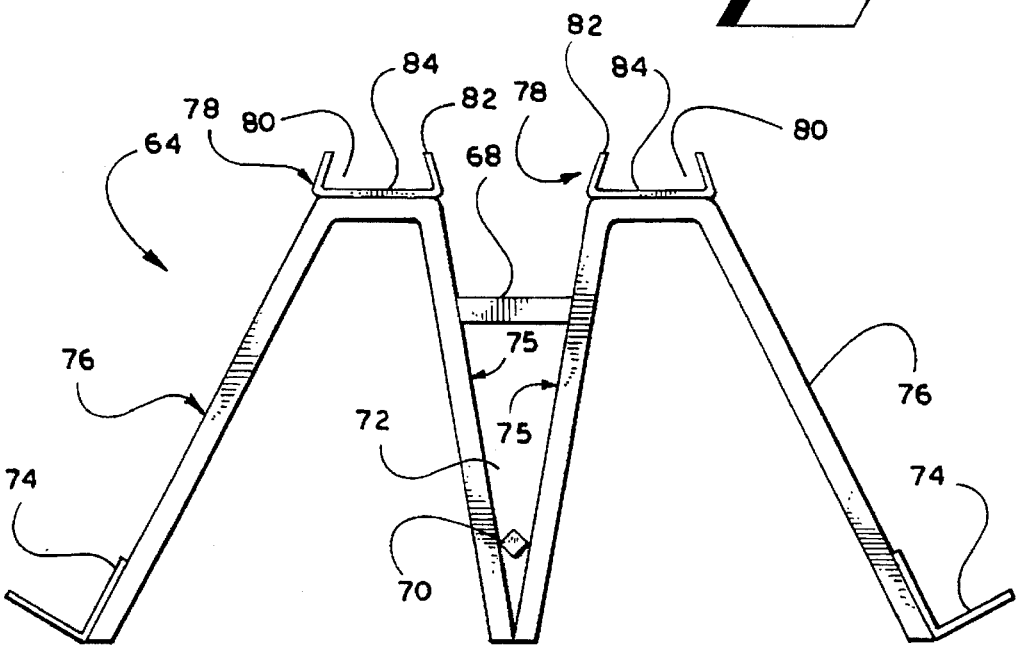

TREADLE AND ROADWAY TREADLE ASSEMBLY

TECHNICAL FIELD

This invention relates generally to deformable treadles and to treadle assemblies containing such treadles which are installed in roadways for sensing vehicular traffic flow, for counting the number of axles on individual vehicles, for toll assessment purposes, and the like. More specifically, this invention relates to an improved optical treadle and to a roadway treadle assembly from which such treadles may be individually removed and replaced.

BACKGROUND OF THE INVENTION

Broadly speaking, a treadle is a rubber strip over which vehicle tires roll and which is operative to record the passage of such tires. Typically such treadles are positioned within a rigid tray and buried in the upper surface of a roadway. When deformed, the treadle actuates an electrical counter for counting the number of vehicles passing over the roadway and/or the number of axles of individual vehicles.

For example, U.S. Pat. No. 4,455,456 discloses a treadle assembly that includes a plurality of elongated treadles of generally trapezoidal cross-section. The treadles are formed of a deformable, resilient material such as natural or synthetic rubber, polymer plastic or the like. These treadles are disposed within a steel tray in parallel extending, spaced apart relationship. Elongated retaining bars mounted on base plates are disposed between the treadles to retain the treadles within the tray.

The tray containing the treadles is then mounted on a support frame and buried within a roadway with the upper surface of the treadle extending slightly above the surface of the roadway whereby the tires of vehicles passing along the roadway will roll over the exposed treadles and deform them. Each treadle has a longitudinally extending hollow passageway therethrough containing a pair of elongated metallic, electrical contact strips attached to upper and lower surfaces of the passageway. As the tires of a vehicle cross a treadle, the treadle material is vertically deformed, causing the strips on the upper and lower surfaces of the passageway to be pressed together to close an electrical circuit and actuate a counter. The treadle assembly thus operates as an electrical switch to control a counter in response to a deformation force applied to the treadle by a vehicle tire.

Another compressible treadle switch assembly for use in a roadway is disclosed in U.S. Pat. No. 2,885,508. As in the previously mentioned patent, this treadle contains a longitudinally extending passageway having elongated, spaced apart electrical contact strips attached to upper and lower surfaces of the passageway. Vehicle tires rolling over the treadle deform the passageway to bring the strips into contact with one another to actuate an electrical counting circuit.

Treadles operating on the principle of electrical contacts suffer certain disadvantages. For example, care must be exercised in the shipping and handling of treadles that contain an electrical switch so as not to bend them and thus permanently deform and mechanically short circuit the contact strips. Because of this problem, it is necessary to securely pack such treadles in rigid crates for shipping purposes. Additionally, installing or replacing electrical contact treadles is expensive due to their design and fragility. The process typically requires two workers, an assortment of tools and three hours of roadway downtime. Further still, electrical contact treadles require about 60 pounds of pressure (psi) from a passing vehicle to operate, which generally necessitates limiting the speed of passing vehicles to 45 miles per hour (mph). This is problematic, however, because toll booths are increasingly using express lanes in which vehicles travel at higher rates of speed.

Another problem associated with treadles having electrical switches is that the presence of excessive moisture in the passageway can cause the electrical contact strips to short circuit. Because of this problem, it is essential that the passageway of such treadles be carefully sealed to prevent the introduction of moisture. Thus, the open ends of the passageways must be carefully sealed during treadle use.

Furthermore, treadles having electrical switches typically comprise two halves bonded together around the contact strips. Thus, extreme care must be taken during manufacturing to insure that no gaps exist between the halves such as would allow moisture to enter. However, because it is difficult to obtain an effective moisture seal in most cases, these treadles tend to permanently short out between the terminal strips after a relatively short period of use. On the average, such treadles must be replaced after only about six months of use due to excessive moisture in the passageway that has produced a permanent shorting of the contact strips.

More recently, U.S. Pat. No. 5,250,769 issued to the present inventor and incorporated herein by reference, disclosed an optical treadle assembly that overcomes the problems associated with electrical contact treadle assemblies. The treadle used therein is constructed of a deformable, resilient material that contains a hollow passageway throughout its length. A photocell emitter that generates a light beam and a photocell collector are located at opposite ends of the passageway. When the treadle is deformed by a vehicle tire, the passageway is at least partially closed and interrupts the light beam to the collector, by which the collector generates a signal indicative of the passage of the vehicle tire thereover. This signal may be used to operate a suitable counter or signal device as desired. The passageway is formed with an oval or elliptical cross-section such that the minimum diameter of the cross-section extends in a vertical direction to enhance closure of the passageway to interrupt the light beam when the treadle is compressed.

Because of the absence of electrical contacts, optical treadles are not damaged by the type of bending that occurs during ordinary handling. Thus, they may be allowed to bend and flex during shipping, handling and installation without causing damage thereto. Also because of the absence of electrical contacts, the switching apparatus in optical treadle assemblies is not susceptible to electrical short circuiting and permanent damage caused by the presence of excessive moisture in the treadle passageway. Thus, optical switching apparatus has a greater longevity than that of electrical contact switching apparatus.

Due to the longevity of the optical switching apparatus, the factor limiting life expectancy of an optical treadle assembly is the life expectancy of the treadle, which gradually becomes worn and/or permanently deformed during use. Once a treadle is worn or permanently deformed, the passageway may remain partially closed, continuously interrupting the light beam even when vehicles are not passing over the treadle. Thus no signal is generated that a vehicle tire has passed.

Thus, to minimize the replacement of treadles in the roadway assembly, there exists a need for a more durable treadle of increased longevity. To further increase treadle longevity, there exists a need for more reliable light beam interruption upon the passage of a vehicle tire. With such reliable interruption, the passage of a vehicle could be registered even with a worn treadle.

Additionally, because it is inevitable that even such an improved treadle will eventually fail due to wear, there exists a need for a roadway treadle assembly that allows a failed treadle to be quickly and easily replaced.

SUMMARY OF THE INVENTION

The present invention provides a better solution to solving the problems in the art described above by providing an optical treadle of extended longevity. The treadle is of unitary construction with an improved cross-sectional passageway shape that more effectively interrupts light when a vehicle tire passes thereover. A treadle assembly with permanently affixed light transmitting and light receiving means is also provided such that a failed assembly can be quickly replaced as a unit. Further, a roadway treadle assembly comprising a frame for installation in a roadway and an adapter plate for adapting a preexisting treadle frame is provided for surface mounting the treadle assembly across a surface portion of a roadway.

More specifically described, the present invention is an optical treadle adapted for disposition in a surface portion of a roadway. The treadle comprises an elongated body of deformable material that is of unitary construction. A hollow passageway opening at opposite ends of the elongated body is provided. The passageway has a vertical axis normal to a base of the elongated body and a horizontal axis parallel to the base. The vertical axis is comparatively short with respect to the horizontal axis to facilitate closure of the passageway upon deformation of the elongated body caused by a vehicle tire passing thereover. The passageway may be hexagonal or quadrilateral in cross-section taken perpendicular to its length.

The optical treadle may be integrated with a light transmitting and light receiving means to form an optical treadle assembly. The light transmitting means transmits a light beam through the passageway and is permanently affixed at one end of the passageway. The light receiving means is also permanently affixed and receives the light beam and generates an output signal upon interruption of the light beam, indicative of the passage of a vehicle tire over the optical treadle.

In another aspect of the present invention, the treadle assembly may be integrated with an elongated mounting frame to form a roadway treadle assembly for disposition in a surface portion of a roadway. The mounting frame includes a plurality of elongated channels defined in an upper surface of the mounting frame. The channels slope outward from an upper end toward a bottom such that the channels are narrower at the upper end than at the bottom. The channels are further open at opposite ends of the mounting frame to allow easy access to treadle assemblies disposed therein.

The treadle assemblies fit within the channels such that a vehicle tire passing thereover will deform the elongated body and close a portion of the passageway. A junction box is disposed at one end of the mounting frame for receiving wiring of the light transmitting and the light receiving means. If the light transmitting and light receiving means are located at opposite ends of the elongated body, a second passageway is provided in the elongated body as a wiring conduit such that the wiring of one of the light transmitting or light receiving means may extend internally to the junction box from an opposite end of the elongated body.

An adapter plate for adapting a treadle receptacle of a preexisting roadway treadle frame to receive the optical treadle is also provided. The adapter plate comprises a mounting tray sized to fit the treadle receptacle. The upper surface of the mounting tray has a plurality of channels defined therein. The channels slope outward from an upper end toward a bottom such that the channels are narrower at the upper end than at the bottom. Like the channels of the mounting frame, the channels of the mounting tray are open at opposite ends to allow easy access to treadle assemblies disposed therein.

Thus, it is an object of the present invention to provide an improved treadle.

It is further an object of the present invention to provide a more reliable treadle.

Yet another object of the present invention is to provide an improved treadle assembly.

It is a further object of the present invention to provide an improved treadle assembly that may be easily replaced in a roadway assembly without special equipment.

It is still further an object of the present invention to provide an improved treadle assembly that operates to effectively count high speed vehicle passes.

Still another object of the present invention is to provide an improved roadway treadle assembly.

It is further yet another object of the present invention to provide an improved roadway treadle assembly needing only a single junction box.

It is still yet another object of the present invention to provide an improved roadway treadle assembly from which treadles may be easily removed and replaced by one person.

It is still another object of the present invention to provide an improved adapter plate for adapting a treadle receptacle of a preexisting roadway treadle frame to receive the improved treadle assembly.

These and other objects, features and advantages of the invention will become apparent to those skilled in the art from the following detailed description and attached drawings upon which, by way of example, only a preferred embodiment of my invention is illustrated.

BRIEF DESCRIPTION OF THE DRAWINGS

FIG. 1 is a perspective view of a first embodiment of an optical treadle showing a first embodiment shape of an optical passageway in accordance with the present invention.

FIG. 2 is a cross sectional elevation view of a second embodiment of an optical treadle showing a second embodiment shape of an optical passageway in accordance with the present invention.

FIG. 3 is a cross sectional elevation view of an optical treadle assembly showing the optical treadle of FIG. 1 with a pair of collars mounted in cavities of the optical passageway for receiving a light transmitter and a light receiver of a photocell system.

FIG. 4A is a perspective view of the light transmitter of FIG. 3.

FIG. 4B is a perspective view of the light receiver of FIG. 3.

FIG. 5 is a cross sectional elevation view of a roadway treadle assembly for mounting the optical treadle assembly of FIG. 3 in a roadway.

FIG. 6 is a top plan view of the roadway treadle assembly of FIG. 5.

FIG. 7 is a cross sectional elevation view of the mounting frame of the roadway treadle assembly of FIG. 5.

DETAILED DESCRIPTION

Figure 9:
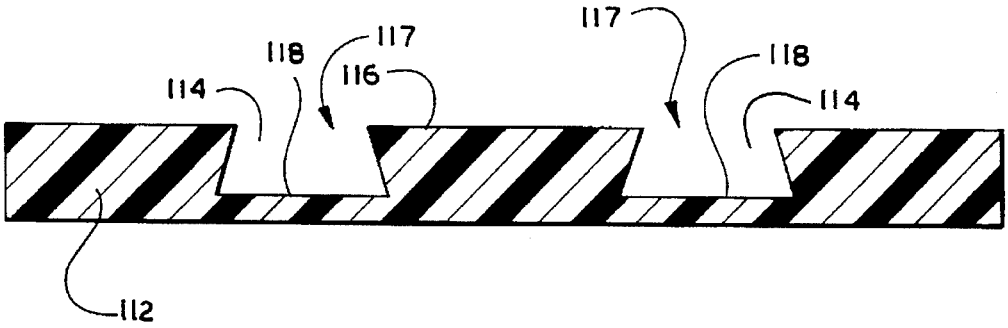
FIG. 9 is a cross sectional elevation view of a two treadle adapter plate for use in connection with the preexisting mounting frame of FIG. 8.

Referring now in more detail to the drawings, in which like numerals refer to like parts throughout the several views, FIG. 1 shows an optical treadle 20 adapted for disposition in a surface portion of a roadway.

The treadle 20 includes an interior optical passageway 22 that extends throughout the length of the treadle 20 and opens at its ends. The optical passageway 22 is aligned vertically under a raised elongated rib 24 formed on an upper level surface 26 of the treadle 20. When the treadle 20 is disposed in a surface portion of a roadway, the rib 24 is slightly above a traveled surface 90 (FIG. 6) of a roadway 88 such that a vehicle tire rolling over the rib 24 will readily deform the treadle 20 to, in turn, momentarily close a portion of the optical passageway 22.

The treadle 20 is elongated and may be of any suitable length to span the width of the roadway. In the preferred embodiment, the treadle 20 has a base 32 with a width of 1⅞ inches, an upper surface width of 1⁷⁄₁₆ inches, a height of ¹¹⁄₁₆ inch (not including the height of the raised rib 24) and a total height of ¹⁵⁄₁₆ inch. The rib 24 is centered along the upper surface 26 with its sides being ³⁄₁₆ inch from the sides of the upper surface 26.

The passageway 22 is horizontally centered in the treadle 20 with the center being about 0.92 inches from the sides of the base 32. Vertically, the center of the passageway 22 is about 0.59 inches above the base 32. The passageway 22 has a vertical axis 28 normal to the base 32 of the treadle and a horizontal axis 30 parallel to the base 32.

In a first embodiment, which is shown in FIG. 1, the passageway 22 is hexagonal in cross section. As used herein, a hexagon will be understood to mean a polygon with six sides that are not necessarily equal in length. The hexagonal cross-section includes three sets of parallel sides with a first set being parallel to the base 32 and elongated in regard to the remaining sets. The elongated sides are preferably 0.250 inches in length with the remaining sides being about 0.177 inches in length. Thus, the minimum axis of the hexagonal cross-section extends in the vertical direction. The vertical axis 28 is comparatively short with respect to the horizontal axis 30 to facilitate closure of the passageway 22 upon deformation of the treadle 20 caused by a vehicle tire passing thereover.

A second passageway embodiment is shown by FIG. 2. In the second embodiment, the passageway 22' is a quadrilateral in cross section. The quadrilateral is generally a diamond in shape with sides that are preferably each ¼ inch in length. Thus, the minimum axis of the quadrilateral extends in the vertical direction. A vertical axis 28' is comparatively short with respect to a horizontal axis 30' to facilitate closure of the passageway 22' upon compression of a treadle 20' caused by a vehicle tire passing thereover.

Regardless of whether the first or second passageway embodiment is used, this remaining portions of a treadle are to the same. For the sake of convenience, therefore, the terminology and reference numerals of the first embodiment will be used where different terms or numerals are used by the embodiments.

The treadle 20 further includes a second passageway 34 that extends throughout the length of the treadle 20 and opens at its ends. The second passageway 34 forms a wiring conduit 35. The wiring conduit 35 is preferably ⁷⁄₃₂ inch in diameter and centered 0.250 inches from both the base 32 and a side of the treadle 20.

The treadle 20 is constructed of EPDM Compound 184 by a single extrusion process. EPDM, a terpolymer of ethylene, propylene and a diene with the residual unsaturated portion of the diene in the side chain, is preferred because of its resilience and resistance to weather, sunlight, oxidation, most caustics, and ozone. Preferably, the treadle 20 has an elongation of 500, a durometer value of 50, a temperature range of −50 to +230° Fahrenheit and a tensile strength of 1,700 pounds of pressure (psi). The elongation value is the fractional increase in the treadle material's length due to stress in tension and thermal expansion. The durometer value is a measure of the hardness of the treadle material. A durometer value of 50 is preferred because it is the most advantageous for treadles 20 that are five to fourteen feet in length, which are the most common lengths. If however, the treadle 20 is decreased in length to below 5 feet, the durometer value should be increased. Conversely, if a longer treadle 20 is used, the durometer should be decreased, but not below a value of 45. The durometer value is varied with the length of a treadle to effect closure of the passageway 22 and thus to maintain accuracy in counting passing vehicles.

Those skilled in the art will understand that the treadle 20 may be constructed of any material that is both deformable and resilient, which includes most types of rubber. A single extrusion process of manufacture is preferred because it eliminates the step of bonding multiple pieces together and the problem of moisture seeping into the passageway 22 at the juncture of the pieces.

As shown in FIG. 3, an optical treadle assembly 36 comprises the treadle 20, a pair of collars 38, a light transmitting means 44 and a light receiving means 46. The light transmitting means 44 and the light receiving means 46 are mounted in the collars 38. The collars 38 are mounted in a pair of cavities 42 that extend 3.4 inches into the passageway 22 at each edge of the treadle 20 and that are ⅝ inch in diameter. The cavities 42 are formed by drilling out of the treadle 20 in predetermined locations after the treadle 20 has been extruded and cured.

Each cavity 42 is horizontally centered in the treadle 20 with the center being slightly less than an inch from the sides of the base 32. The vertical centers of the cavities 42, however, are in a predetermined vertical offset with the passageway 22. By the cavities 42, which contain the light transmitting means 44 and the light receiving means 46, being vertically offset, the amount of light directed into the passageway 22 by the light transmitting means 44 and thus received by the light receiving means 46 is controlled. The greater the vertical offset, the less the amount of light that will be received by the light receiving means 46. Thus, the cavities 42 are vertically offset to a predetermined distance whereby the light receiving means 46 receives an optimum amount of light.

The offset is a function of the distance between the light transmitting means 44 and the light receiving means 46 as well as the durometer value of the treadle 20. As the distance between the light transmitting means 44 and the light receiving means 46 increases, so too does the amount of directed light that is lost to dispersion in the passageway 22. To compensate for such dispersion, the vertical offset is decreased for longer distances to increase the amount of light directed into the passageway 22. The durometer value of a treadle 20 effects the closure of the passageway 22 upon a vehicle tire passing over the treadle 20. Accordingly, for hard treadles with reduced passageway 22 closure, the vertical offset is decreased to increase the amount of directed light so that the reduced closure remains effective to signal a vehicle tire passing over the treadle 20. For treadle lengths of five to fourteen feet, with a durometer value of 50, the cavities 42 are centered 17/32 inch above the base 32.

The collars 38 are circular with an outside diameter of 5/8 inch and a length of 2.4 inches. Thus, the collars are each recessed 1.0 inch within the cavities 42. Internally, the collars are threaded to receive an insert having 12 by 1 mm threads. The collars 38 are preferably constructed of stainless steel so they will not corrode over an extended period of use.

To permanently mount the collars 38 in the cavities 42, each collar 38 is first cleaned with toluene and allowed to dry. Next, the collar 38 is dipped into a 50/50 mixture of THIXON 310™, a metal-to-rubber bonding primer or cover coat manufactured by Morton International, and methanol and allowed to dry for one hour. The collar is then painted with CHEMLOC 205™, a rubber-to-metal adhesive primer or cover coat manufactured by Lord Corporation, Pennsylvania, and again allowed to dry for a hour. Afterward, the collar 38 is painted with Thixon 508™ primer, allowed to dry for a hour, then painted with EPDM cement and allowed to dry another hour. Care should be taken during the cementing step to prevent the EPDM cement from getting inside the collar 38, as the light transmitting means 44 or light receiving means 46 must be threadably mounted therein.

The cavities 42 are prepared for the collars 38 by first cleaning the surfaces of the EPDM that surrounds the cavities 42 with toluene and allowing them to dry. Next, each cavity 42 is painted with EPDM cement and allowed to dry for a hour. After all the drying is completed, the prepared collar 38 is fully inserted into the prepared cavity 42. The portion of the treadle 20 containing the cavity 42 with the inserted collar 38 is then inserted into a press for 14 minutes at 95 pounds of pressure (psi) and 325 degrees Fahrenheit. During that time, the collar 38 is bonded to the surrounding EPDM. If desired, the bond may be tested with a threaded tool.

The light transmitting means or light emitter 44, which is best shown by FIG. 4A, comprises a cylindrical housing 48 that is exteriorly threaded to mount within the collar 38. The light emitter 44 of the disclosed embodiment is preferably a model M126E-34140 light emitter manufactured by Banner Engineering Corp., Minneapolis, Minn. The cylindrical housing 48 is constructed of stainless steel and completely sealed to prevent moisture from entering therein and damaging the circuitry of the light emitter 44. As a further precaution against moisture damage to the circuitry, the circuitry is epoxy-encapsulated. A light source 50 is disposed at a front end of the cylindrical housing 48. A set of transmit wires 52 that powers the light source 50 is received at a back end of the cylindrical housing 48.

The light receiving means or light collector 46, which is best shown by FIG. 4B, comprises a cylindrical housing 54 that is exteriorly threaded to mount within the collar 38. The light collector 46 of the disclosed embodiment preferably a model M12SP6R-34141 photoelectric sensor manufactured by Banner Engineering Corp. The cylindrical housing 54 is constructed of stainless steel and completely sealed to prevent moisture from entering therein and damaging the circuitry of the light collector 46. As a further precaution against moisture damage to the circuitry, the circuitry is epoxy-encapsulated. A light sensor 56 is disposed at a front end of the cylindrical housing 54. A set of receive wires 58 that powers the light sensor 56 and that transmit interrupt data is received at a back end of the cylindrical housing 54.

The light collector 46 further includes a green light emitting diode (LED) 60 and a yellow LED 62 for diagnostic purposes. A steady green LED 60 signifies that the power is on while a flashing green LED 60 signifies that the output voltage exceeds its limit and that the output is thus overloaded. A steady yellow LED 60 signifies that a normally open output is on while a flashing yellow LED 60 signifies that the normally closed, or alarm output is on.

The light emitter 44 and the light collector 46 are permanently affixed in their respective collars 38 by applying Loctite Threadlocker 277™ adhesive to the threads and screwing them into the collars 38. One effect of permanently affixing the light emitter 44 and the light collector 46 to the collars 38 and permanently mounting the collars 38 in the cavities 42 is to seal the passageway 22 from moisture. To insure such sealing, the one inch space in each cavity behind the collar 38 is sealed with a suitable sealant, such as Dow Coming Silicone Sealant 732™.

Another effect is that the resulting treadle assembly 36 is self contained with only the wiring protruding therefrom. One of the transmit wires 52 or the receive wires 58 are extended internally of the treadle 20 to an opposite end thereof via the wiring conduit 35. As a result, the treadle assembly 36 can be easily handled and installed. In the disclosed embodiment, the transmit wires 52 are extended in the wiring conduit 35 because there are fewer transmit wires 52 than receive wires 58.

A roadway treadle assembly 86 for mounting the treadle assemblies 36 in a surface portion of a roadway is shown in FIGS. 5 and 6. The roadway treadle assembly 86 includes a mounting frame 64 that is permanently installed in the roadway 88 such that the top is essentially flush with the traveled surface 90 of the roadway 88. The mounting frame 64 may be of any length suitable to span the width of the roadway 88.

As best shown by FIG. 7, the mounting frame 64 comprises two supports 66 and two treadle receptacles 78. Each treadle receptacle 78 is mounted onto one of the supports 66 such that the upper ends 82 of the treadle receptacles 78 form the top of the mounting frame 64.

The supports 66 are constructed of 3/8 inch square steel and are each generally an inverted U in shape. The inverted U-shaped supports 66 are disposed side-by-side and joined together every 12 inches by a 3/8 inch square steel strut 68. Additionally, a 3/8 inch square steel support 70 extends along the bottom of a crevice 72 formed between the inner legs 75 of the U-shaped supports 66. An angle bracket 74 is mounted along the bottom of the outside legs 76 of the supports 66 to further buttress the mounting frame 64.

The treadle receptacles 78 each form a channel 80 for receiving a treadle assembly 36. The channels 80 slope outward from the upper end 82 of the treadle receptacles 78 toward a bottom 84 such that the channels 80 are narrower at the upper end 82 than at the bottom 84. The channels 80 are open at the opposite ends of the mounting frame 64.

The channels 80 are sized to receive a treadle 20 having predetermined dimensions. In the preferred embodiment, each channel 80 is sized to receive a treadle assembly 36. The channels 80 are each 1⅜ inches wide at the top of the channels 80 (1/16 of an inch less than the treadle 20), 1⅞ inches wide at the base 84 (the same as the treadle 20), and 23/32 inches in height (1/32 of an inch less than the treadle 20). These dimensions and those of the treadle 20 are optimum for keeping the treadle in the channel 80 and not interfering with the deformation of the treadle by a passing vehicle tire.

Returning to FIGS. 5 and 6, the mounting frame 64 is installed by digging a pit 96 across the roadway 88. The mounting frame 64 is then leveled and squared with the roadway 88 such that the upper end 82 of the treadle receptacle 78 is flush with the traveled surface 90 of the roadway 88. Next, the mounting frame 64 is secured in the pit 96, and concrete 92 is poured flush with the traveled surface 90 of the roadway. Thereafter, the concrete 92 is allowed to cure. The complete procedure normally takes between three and seven days.

A treadle assembly 36 is inserted into a channel 80 of the mounting frame 64 by first connecting the transmit wires 52 and the receive wires 58 to a terminal strip 98 in a junction box 94. The junction box 94 is joined to the mounting frame 64 at a point adjacent to the traveled portion of the roadway. The wires enter the junction box 94 via a conduit (not shown) located on the side of the junction box 94 abutting the mounting frame 64. The junction box 94 is provided with a removable cover plate 100, the outer surface of which is exposed and essentially flush with the roadway surface to permit access to the interior thereof as desired.

Next, one side of the treadle assembly 36 is placed in the channel 80 along its entire length. Afterward, a blunt chisel is used to secure four inches of the treadle assembly 36 completely into the channel 80 at each end. Installation is then completed by hitting the raised edge of the remaining portion of the treadle assembly 36 with a plastic hammer. From start to finish, the process takes only one worker and can be completed in about 20 minutes. Thus, a treadle assembly can be secured in place with substantially less cost than could be done with treadle assemblies of the prior art.

If a treadle assembly 36 fails, it is replaced by first cutting the transmit wires 52 and the receive wires 58 of the failed treadle at the junction box 94. The cut wires can later be used to pull the wires of the replacement treadle assembly 36 through the conduit to the junction box 94. Next, an end of the failed treadle assembly is pried from the channel 80 by means of a screwdriver or similar tool to a point where the raised end can be securely grasped. By gripping the raised end, the remaining portion of the failed treadle assembly can then be pulled out. The replacement treadle assembly is then installed by the same process by which the treadle assembly 36 was originally installed. Thus, the replacement process takes only one worker and can be completed in about 30 minutes. As a result, a failed treadle assembly can be replaced with substantially less cost than could be done with treadle assemblies of the prior art.

Figure 8:
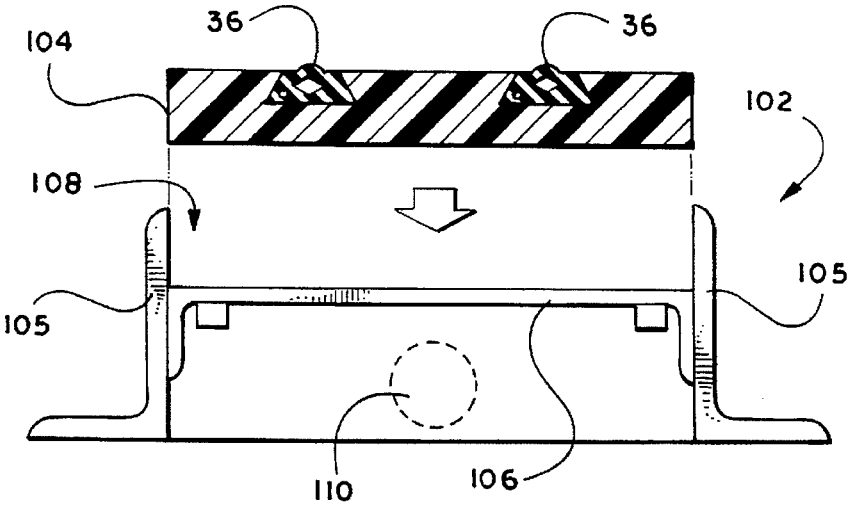
FIG. 8 is a cross sectional elevation view of a preexisting mounting frame of an electrical contact treadle.

Referring now to FIG. 8, besides operating in connection with the roadway treadle assembly 86 of the present invention, the treadle assembly 36 may be adapted to operate in a preexisting roadway treadle frame 102 by means of an adapting plate 104. As shown in FIG. 8, a typical preexisting roadway frame 102 comprises a base 106 mounted between a pair of opposing side brackets 105. Together, the brackets 105 and the base 106 form a rectangular treadle receptacle 108.

Although the rectangular treadle receptacle 108 is not ideal, replacement of the preexisting frame 102 would not be feasible because it is concreted into the roadways. To replacing the preexisting frame 102, about four workers, a back hoe, a hoe ram, a dump truck and a lift would be required. Additionally, the lane of the preexisting frame 102 would be closed for about a week during the replacement. As a result, adaptation is necessary to compete for supply contracts in existing treadle applications that have frames of a dimension different from the treadle assembly 36.

Figure 10:
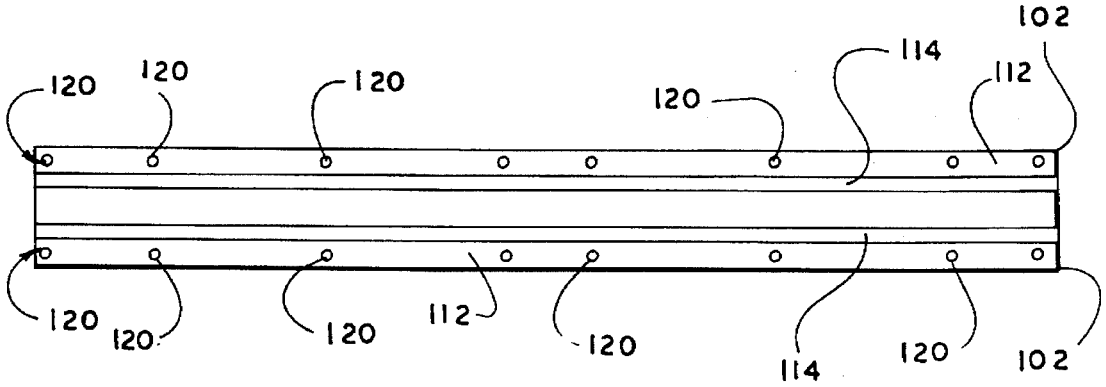
FIG. 10 is a top plan view of the two treadle adapter plate of FIG. 9.

As shown in FIGS. 9 and 10, the adapting plate 104 of the present invention comprises a mounting tray 112 sized to fit the treadle receptacle 108 of the preexisting frame 102. The preferred mounting tray 112, which fits a standard two treadle preexisting frame 102, is 10⅝ inches in width and 15/16 inch in height.

A plurality of channels 114 for securing treadle assemblies 36 are defined in an upper surface 116 of the mounting tray 112. In the preferred embodiment, the channels 114 are positioned 2 7/16 inches from the sides of the mounting tray 112 and are spaced 3.0 inches apart from one another. The channels 114 slope outward from the upper surface 116 of the mounting tray 112 toward a bottom 118 such that the channels are narrower at an upper end 117 than at the bottom 118. The channels 114 are open at the opposite ends of the mounting tray 112.

The channels 114 are sized to receive a treadle having predetermined dimensions. In the preferred embodiment, each channel 114 is sized to receive a treadle assembly 36. The channels 114 are each 1⅜ inches wide at the upper surface 82 (1/16 of an inch less than the treadle 20), 1⅞ inches wide at the base 84 (the same as the treadle 20), and 23/32 inches in height (1/32 of an inch less than the treadle 20). These dimensions and those of the treadle 20 are optimum for keeping the treadle 20 in the channel 114 and not interfering with the deformation of the treadle by a passing vehicle tire.

The mounting tray 112 is constructed of ultra high molecular weight polyethylene. Ultra high molecular weight polyethylene is preferred because it is less expensive, naturally black in color, and resistant to corrosion and ultraviolet light. Additionally, a mounting tray constructed of ultra high molecular weight polyethylene weights only about half as much as a similar tray in the prior art, which is constructed of aluminum. Thus, the adapting plate of the present invention is less expensive to manufacture, cheaper to ship and easier to install than those of the prior art.

The mounting tray 112 is installed in the treadle receptacle 108 by bolting it to preexisting holes of the frame 102 via matching holes 120 in the mounting tray 112. The matching holes 120 are shown best by FIG. 10. The matching holes 120 are countersunk into the upper surface 116 of the mounting tray 112 such that they are flush with the traveled portion 90 of the roadway. The treadle assemblies 36 am inserted into the channels 114 of the mounting tray 112 in same manner as is done in connection with the mounting frame 64. The transmit wires 52 and the receive wires 58 of the treadle assemblies 36 may extend to a preexisting junction box (not shown) through a conduit 110 in the preexisting frame 102 (FIG. 8).

Figure 11:
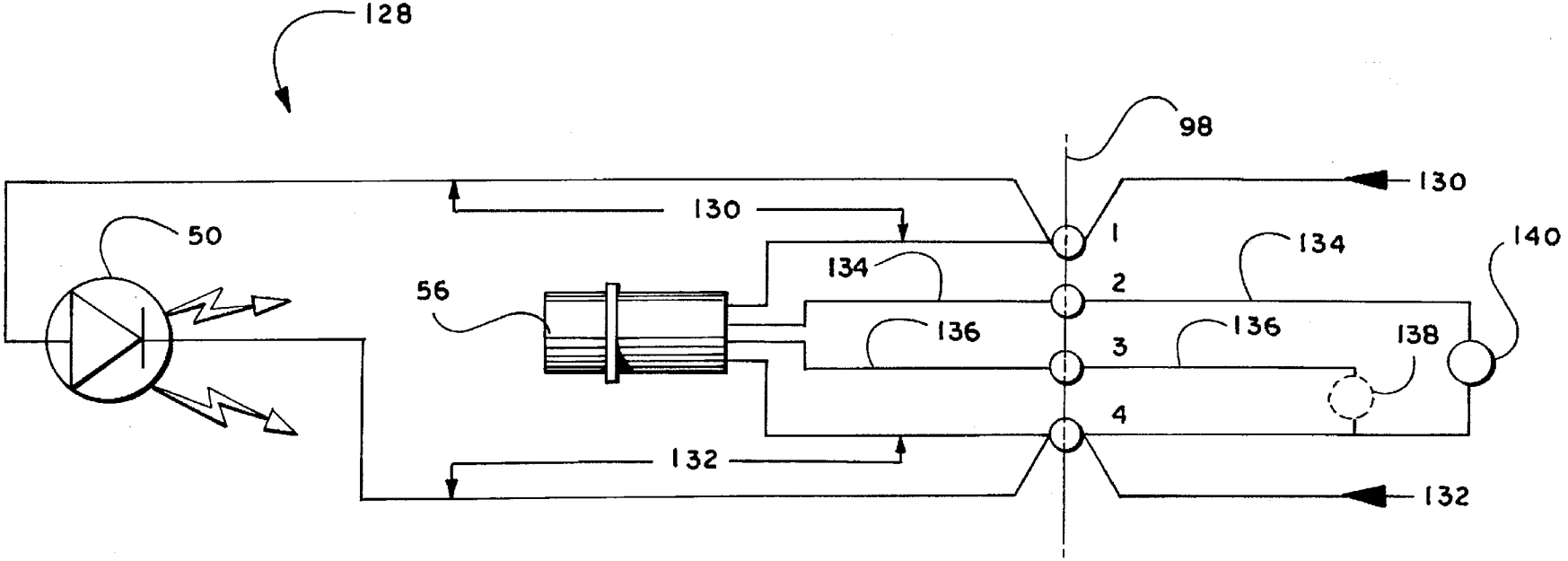
FIG. 11 is an electrical schematic diagram of an interrupt circuit for use in connection with the roadway treadle assembly of FIG. 5.

The transmit wires 52 and the receive wires 58 are connected to an interrupt circuit 128 for tracking vehicle passes as shown in FIG. 11. Power is supplied via line 130 with line 132 being common. When the treadle assembly 36 is in operation, the light source 50 directs a collimated beam of electromagnetic radiation, preferably either visible or infrared light, along the passageway 22 to the opposing light sensor 56. While the passageway 22 is open, the light sensor 56 senses light from the light source 50 and generates a voltage at, or closes, a light output terminal 136. Because the passageway 22 is normally open during treadle operation, the light output terminal 136 is normally closed.

Now when a vehicle tire rolls over the rib 24, the treadle 20 is deformed which, in turn, effectively closes the passageway 22 to interrupt the beam of light directed by the light source 50 to the opposing light sensor 56. For the treadle 20, which preferably has a durometer value of 50, only about 38 pounds of pressure (psi) are required to effectively close the passageway 22. Because of that low required pressure, the treadle assembly 36 of the present invention can be used in high speed applications, such as the express lanes of toll booths, to accurately count vehicles traveling at speeds up to 80 miles per hour (mph). Additionally, if necessary, the required pressure can be lowered still further by lowering the durometer value of the treadle 20.

Interruption of the light beam causes the light sensor 56 to drop the voltage at, or open, the light output terminal 136 and to generate a voltage at, or close, a dark output terminal 134. The voltage at the dark output terminal 134 activates a relay 140 which, in turn, operates a conventional counter of any suitable type to count the passage of a vehicle over the treadle or the passage of an axle of a vehicle thereover, as the case may be. This type of interrupt circuit is commonly referred to as a dark operating system because the counter is operated by a relay that is activated by the generation of voltage at a dark output terminal.

Alternatively, a light operating system may be used wherein the relay 140 at the dark output terminal 134 is replaced by a relay 138 (shown in phantom) at the light output terminal 136. In such a system, the relay is activated by a drop in voltage at the light output terminal 136 rather than the presence of voltage at the dark output terminal 134. The relay 138 operates a conventional counter of any suitable type to count the passage of a vehicle over the treadle or the passage of an axle of a vehicle thereover, as the case may be.

Those skilled in the art will understand that the above described photocell system arrangement may be varied within the scope of the present invention. Thus, the light transmitting means 44 and the light receiving means 46 may be oriented differently than is specifically described above. For example, a composite transmitting/receiving means (not shown) may be arranged in the passageway 22 at an opposite end of a mirror or reflector (not shown). In such an arrangement, the composite transmitter/receiver will both transmit light to the reflector and receive reflected light back from the reflector. A counter is operated upon the interruption of the reflected light.

Although the present invention has been described with respect to specific details of a certain preferred embodiment thereof, it is not intended that such details limit the scope or coverage of this patent other than as specifically set forth in the following claims.

I claim:

1. An optical treadle adapted for disposition in a surface portion of a roadway comprising:

an elongated body of deformable material, said elongated body being of unitary construction; and a hollow passageway opening at opposite ends of said elongated body, wherein said passageway defines a polygon in cross-section, said polygon having a vertical axis normal to a base of said elongated body and a horizontal axis parallel to said base, the interior surfaces of said hollow passageway intersecting to define creases at the corners of said polygon that lie on said horizontal axis to facilitate closure of said passageway upon deformation of said elongated body caused by a vehicle tire passing thereover.

2. An optical treadle adapted for disposition in a surface portion of a roadway as recited in claim 1 wherein said passageway is hexagonal in cross-section taken perpendicular to its length.

3. An optical treadle adapted for disposition in a surface portion of a roadway as recited in claim 2 wherein said hexagonal cross-section comprises three sets of parallel sides with a first set being parallel to said base and elongated in regard to the remaining sets.

4. An optical treadle adapted for disposition in a surface portion of a roadway as recited in claim 1 wherein said passageway is quadrilateral in cross-section taken perpendicular to its length.

5. An optical treadle adapted for disposition in a surface portion of a roadway as recited in claim 4 wherein said quadrilateral is a parallelogram.

6. An optical treadle adapted for disposition in a surface portion of a roadway as recited in claim 5 wherein said parallelogram is diamond in shape, having two sets of parallel sides.

7. An optical treadle adapted for disposition in a surface portion of a roadway as recited in claim 1 further comprising a second passageway opening at opposite ends of said elongated body, said second passageway forming a wiring conduit.

8. An optical treadle adapted for disposition in a surface portion of a roadway as recited in claim 1 wherein said deformable material is EPDM.

9. An optical treadle adapted for disposition in a surface portion of a roadway comprising:

an elongated body of deformable material; and a hollow passageway opening at opposite ends of said elongated body, wherein said passageway is hexagonal in cross-section taken perpendicular to its length, said hexagonal having a vertical axis normal to a base of said elongated body and has a horizontal axis parallel to said base, said vertical axis being comparatively short in regard to said horizontal axis to facilitate closure of said passageway upon deformation of said elongated body caused by a vehicle tire passing thereover.

10. An optical treadle adapted for disposition in a surface portion of a roadway as recited in claim 9 wherein said hexagonal cross-section comprises three sets of parallel sides with a first set being parallel to said base and elongated in regard to the remaining sets.

11. An optical treadle adapted for disposition in a surface portion of a roadway comprising:

an elongated body of deformable material; and a hollow passageway opening at opposite ends of said elongated body, wherein said passageway is quadrilateral in cross-section taken perpendicular to its length, said quadrilateral having a vertical axis normal to a base of said elongated body and has a horizontal axis parallel to said base, said vertical axis being comparatively short in regard to said horizontal axis to facilitate closure of said passageway upon deformation of said elongated body caused by a vehicle tire passing thereover.

12. An optical treadle adapted for disposition in a surface portion of a roadway as recited in claim 11 wherein said quadrilateral is a parallelogram.

13. An optical treadle adapted for disposition in a surface portion of a roadway as recited in claim 12 wherein said parallelogram is diamond in shape, having two sets of parallel sides.

14. An optical treadle assembly comprising:

an optical treadle having an elongated body of deformable material with a hollow passageway opening at opposite ends thereof, said passageway defining a polygon in cross-section taken perpendicular to its length, said elongated body adapted for disposition in a surface portion of a roadway such that a vehicle tire passing thereover will deform said elongated body to close a portion of said passageway, the interior surfaces of said hollow passageway intersecting to define creases at the horizontal edges of said polygon that facilitate closure of said passageway upon deformation of said elongated body caused by a vehicle tire passing thereover;

means permanently affixed at one end of said passageway for transmitting a light beam through said passageway; and means permanently affixed to receive said light beam and for generating an output signal upon interruption of said light beam, indicative of the passage of a vehicle tire over said optical treadle.

15. An optical treadle assembly as recited in claim 14 wherein said light transmitting means and said light receiving means are disposed at opposite ends of said passageway.

16. An optical treadle assembly as recited in claim 15 wherein said light transmitting means and said light receiving means are slightly recessed from their respective ends of said passageway.

17. An optical treadle assembly as recited in claim 15 further comprising a pair of collars permanently bonded in a pair of cavities at opposite ends of said passageway, wherein said light transmitting means is permanently mounted in one of said collars and said light receiving means is permanently mounted in a remaining collar.

18. An optical treadle assembly as recited in claim 17 wherein said pair of collars are disposed in said cavities in predetermined relation with said passageway such that when said light transmitting means is mounted in one collar and said light receiving means is mounted in the remaining collar, said light transmitting means and said light receiving means are in predetermined alignment.

19. An optical treadle assembly as recited in claim 14 wherein said elongated body of deformable material is of unitary construction.

20. An optical treadle assembly as recited in claim 14 further comprising a second passageway opening at opposite ends of said elongated body, said second passageway forming a wiring conduit such that wiring of one of said light transmitting means or said light receiving means may extend internally from one end of said elongated body to an opposite end.

21. A roadway treadle assemble comprising:

an elongated mounting frame adapted for disposition in a surface portion of a roadway;

a plurality of elongated channels defined in an upper surface of said mounting frame, said channels sloping outward from said upper surface toward a bottom such that said channels are narrower at said upper surface than at said bottom, said channels opening at opposite ends of said mounting frame;

an optical treadle having an elongated body of deformable material with a hollow passageway opening at opposite ends thereof, said passageway defining a polygon in cross-section taken perpendicular to its length, said elongated body being of unitary construction and adapted to fit within said channel such that a vehicle tire passing over said mounting frame will deform said elongated body to close a portion of said passageway;

the interior surfaces of said hollow passageway intersecting to define creases at the horizontal edges of said polygon that facilitate closure of said passageway upon deformation of said elongated body caused by a vehicle tire passing thereover;

means permanently affixed at an end of said passageway for transmitting a light beam through said passageway, said light transmitting means having a set of transmit wires;

means permanently affixed at an opposite end of said passageway to receive said light beam and for generating an output signal upon interruption of said light beam, indicative of the passage of a vehicle tire over said optical treadle, said light receiving means having a set of receive wires;

a second passageway in said elongated body opening at opposite ends thereof, said second passageway forming a wiring conduit such that one of said transmit wires or said receive wires may extend internally from one end of said elongated body to an opposite end; and a junction box disposed at an end of said mounting frame, said junction box receiving said transmit wires and said receive wires.

22. An optical treadle adapted for disposition in a surface portion of a roadway as recited in claim 21 wherein said passageway is hexagonal in cross-section taken perpendicular to its length.

23. An optical treadle adapted for disposition in a surface portion of a roadway as recited in claim 22 wherein said hexagonal cross-section comprises three sets of parallel sides with a first set being parallel to said base and elongated in regard to the remaining sets.

24. An optical treadle adapted for disposition in a surface portion of a roadway as recited in claim 21 wherein said passageway is quadrilateral in cross-section taken perpendicular to its length.

25. An optical treadle adapted for disposition in a surface portion of a roadway as recited in claim 22 wherein said quadrilateral is a parallelogram.

26. An optical treadle adapted for disposition in a surface portion of a roadway as recited in claim 25 wherein said parallelogram is diamond in shape, having two sets of parallel sides.

27. An optical treadle adapted for disposition in a surface portion of a roadway as recited in claim 21 wherein said deformable material is EPDM.

28. An optical treadle adapted for disposition in a surface portion of a roadway as recited in claim 1, wherein said vertical axis is comparatively short in regard to said horizontal axis.

29. An optical treadle assembly as recited in claim 14, wherein said polygon has a vertical axis normal to a base of said elongated body and a horizontal axis parallel to said base, said vertical axis being comparatively short in regard to said horizontal axis.

* * * * *